US006701583B1

(12) United States Patent
McCullough

(10) Patent No.: US 6,701,583 B1
(45) Date of Patent: Mar. 9, 2004

(54) JEWELRY CLASP CASING

(76) Inventor: Mary McCullough, 1 Armour Rd., Hatboro, PA (US) 19040

( * ) Notice: Subject to any disclaimer, the term of this patent is extended or adjusted under 35 U.S.C. 154(b) by 0 days.

(21) Appl. No.: 10/263,450

(22) Filed: Oct. 3, 2002

(51) Int. Cl.[7] ..... A44C 5/00

(52) U.S. Cl. ..... 24/116 R; 24/685; 24/583.11; 24/116 A; 63/3.2

(58) Field of Search ..... 24/685, 71.1, 68 CT, 24/583.11, 116 R, 116 A; 63/3.2; D11/87

(56) References Cited

U.S. PATENT DOCUMENTS 2,051,591 A * 8/1936 Brogan
2,586,758 A * 2/1952 Zerr
4,611,368 A * 9/1986 Battersby ..... 24/116 R
5,722,260 A * 3/1998 Mangano ..... 63/3.1
6,422,036 B1 * 7/2002 Giannis et al. ..... 63/3.1
6,470,708 B1 * 10/2002 Green ..... 63/3.2

* cited by examiner

*Primary Examiner*—Robert J. Sandy
(74) *Attorney, Agent, or Firm*—Lamorte & Associates

(57) ABSTRACT

An apparatus and method for selectively adjusting the hanging length of a piece of chain jewelry. A clasp casing is provided that receives the clasp ends of a piece of chain jewelry. Within the clasp casing is a matrix of posts. The clasp ends of the jewelry chain are fed into the casing and attached to separate posts. If attached to posts near the ends of the casing, the hanging length of the jewelry chain can be increased because the casing adds length to the jewelry chain. By wrapping the jewelry chain around the posts inside the casing, the hanging length of the jewelry chain can be dramatically shortened.

13 Claims, 3 Drawing Sheets

JEWELRY CLASP CASING

BACKGROUND OF THE INVENTION

1. Field of the Invention

In general, the present invention relates to jewelry clasps of the type that are used on chain necklaces and bracelets. More particularly, the present invention relates to devices that engage jewelry clasps in a selective manner so that the length of the jewelry chain extending from the device can be selectively adjusted.

2. Prior Art Statement

There are many types of jewelry. Often the jewelry is made from flexible chains. This is particularly true in the field of necklaces and bracelets. When a flexible chain is used to create a piece of jewelry, the chain is typically not manufactured to be continuous. Rather, the chain is manufactured as a straight length having two open ends. Each of the ends is terminated with part of a clasp that enables the ends of the chain to be connected around the neck or wrist.

Over the years, many types of clasps that join together the ends of jewelry chains have been invented. In modern jewelry, a very common clasp design involves the use of a locking hoop and a static hoop. With such a clasp, one end of a chain is terminated with a round or elongated static hoop. The opposite end of the chain is terminated with a hoop that can be selectively opened with a locking latch. To join the two hoops, the locking latch must be momentarily moved to the open position. A small lever is typically located just below the locking latch. It is this lever that must manipulated in order to open the locking latch. The locking latch must then be held open while the static hoop is interconnected with the locking hoop. The locking latch is then closed to prevent the two hoops from separating.

For many reasons, different people find it hard to manipulate the locking latch on a claps when either putting on or taking off chain jewelry. This is especially true for necklaces that are clasped out of sight behind the neck. In an attempt to make the opening and closing of jewelry clasps easier, clasp cases have been developed in the prior art that eliminate the need to manipulate the locking latch on a clasp in order to open or close the clasp. Such clasp cases provide a thin post in a casing. The static hoop on one end of the chain and the locking hoop on the opposite side of the chain are then placed around the post. As such, the two ends of the chain are joined to the same point without having to manipulate the small latching lever that is part of the clasp. Such prior art clasp cases are exemplified by U.S. Pat. No. 4,611,368 to Battersby, entitled Decorative And Protective Jewelry Chain Guard.

As is well known in the field of jewelry, necklaces and bracelets come in different lengths. Depending upon the day's fashion, the cut of clothing being worn, the style of the clothing being worn and/or the occasion, a woman may select a necklace of a different length. Consequently, it is common for a woman to have necklaces in a variety of different lengths even though the style of many of the necklaces may be similar.

Often women buy long necklaces. If a woman wants to shorten the length of the necklace, she either ties or otherwise binds the necklace behind her neck. In the prior art, there are devices that enable a necklace to be adjusted in length. Such devices are exemplified by U.S. Pat. No. 3,481,155, to Cook, entitled Combined Necklace And Wristband Including Loop Shortening Means. However, with such devices, the excess chain extends out of the device and is visible. With many cuts of dress, the dangling excess parts of the necklace are unsightly. Furthermore, when prior art necklace shortening devices are used, the ends of the necklace hang free and often become entangled with each other, hair or other objects.

A need therefore exists in the art for a device that can be used to shorten a necklace or bracelet without exposing the unused portions of such jewelry. A need also exists for a device that can shorten a length of jewelry chain while confining the ends of the chain. Furthermore, a need exists for a device that can shorten a length of jewelry chain yet be easily manipulated and operated by a person of less than optimal dexterity or vision. These needs are met by the present invention as described and claimed below.

SUMMARY OF THE INVENTION

The present invention is an apparatus and method for selectively adjusting the hanging length of a piece of chain jewelry. Chain jewelry, like necklaces, have a hanging length that is determined by the length of the chain jewelry between the clasp ends. The present invention is a clasp casing that receives the clasp ends of the chain jewelry. Within the clasp casing is a matrix of posts. The matrix of posts are arranged in three row sets, that include a center post set and a post set on either side of the center post set. The clasp ends of the jewelry chain are fed into the casing and attached to separate posts. If attached to posts near the ends of the casing, the hanging length of the jewelry chain can be increased because the casing adds length to the jewelry chain. However, by wrapping the jewelry chain around the posts inside the casing, the hanging length of the jewelry chain can be dramatically shortened.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
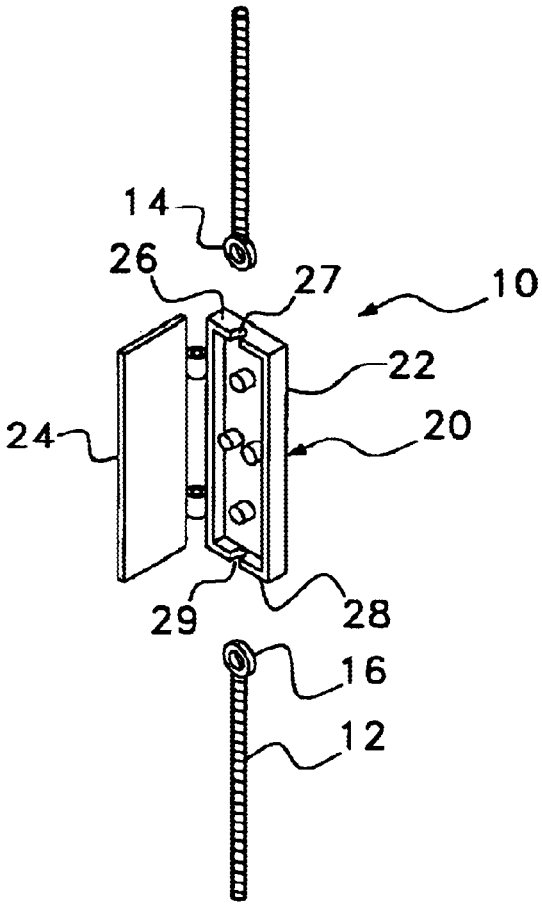
FIG. 1 is a perspective view of one exemplary embodiment of the present invention shown with the ends of a piece of chain jewelry.

Referring to FIG. 1, an exemplary embodiment of the present invention clasp device 10 is shown. The clasp device 10 is shown in conjunction with two opposite ends of a piece of chain jewelry 12. The chain jewelry 12 can be a bracelet, necklace or any similar item. The chain jewelry 12 terminates with a traditional clasp. One end of the chain jewelry terminates with a static hoop 14. The opposite end of the chain jewelry 12 terminates with a lockable hoop 16 that can be selectively opened and closed.

The present invention clasp device 10 contains a casing 20 that can engage the hoop terminated ends 14, 16 of the chain jewelry 12 in a variety of different orientations. As will later be explained, by selectively varying how the chain jewelry is engaged within the casing 20 will determine how much of the chain jewelry 12 is confined within the casing. By adjusting the amount of chain jewelry 12 that is contained within the casing 20, the length of the chain jewelry 12 that extends outside of the casing 20 can be selectively adjusted.

From FIG. 1, it can be seen that the casing 20 of the clasp device 10 has a base section 22 and a lid section 24. The base section 22 and lid section 24 are interconnected along a common hinge joint. As such, the lid section 24 can be selectively closed over the top of the base section 22 or opened to expose the interior of the base section 22.

The base section 22 has a first end 26 and an opposite second end 28. Reliefs 27, 29 are formed in both the first end 26 and the second end 28 of the base section 22 so that the chain jewelry 12 can pass into the interior of the base section 22 without effecting the ability of the lid section 24 to lay flush over the top of the base section 22.

Figure 2:
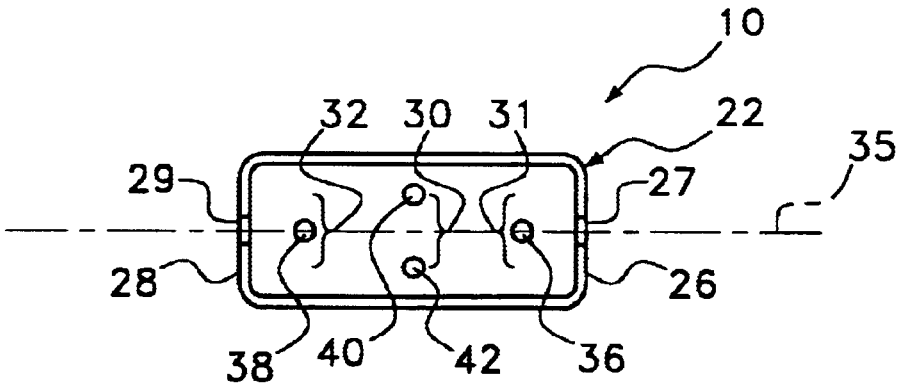
FIG. 2 is a plan view of the base section of the casing.

Referring to FIG. 2, it can be seen that a matrix of posts extend upwardly within the interior of the base section 22. The matrix of posts are divided into three sets, which include first end post set 31, the center post set 30 and the second end post set 32. Each post set contains at least one post and can contain a plurality of posts, as will later be evident. The center post set 30 is disposed in the center of the base section 22. The first end post set 31 is positioned between the center post set 30 and the first end 26 of the base section 22. Conversely the second post set 32 is disposed between the center post set 30 and the second end 28 of the base section 22.

The base section 22 of the casing 20 has a center line 35 that passes between the two reliefs 27, 29 at the first end 26 and the second end 28 of the casing 20. In the shown embodiment, the first end post set 31 contains a single post 36 that is located on the center line 35. Similarly, the second end post set 32 contains a single post 38 that is also located on the center line 35. Accordingly, the post 36 in the first end post set 31 and the post 38 in the second end post set 32 are linearly aligned with the reliefs 27, 29 in the casing 20.

The center post set 30 contains two posts 40, 42 that are disposed above and below the centerline 35 of the base section 22. Both posts 40, 42 are equidistant from the reliefs 27, 29 on either end of the bottom section 22 of the casing 20.

Returning briefly to FIG. 1, it will be understood that the lid section 24 of the casing 20 closes flush, or nearly flush, with the tops of the matrix of posts. Consequently, if the hopped ends 14, 16 of the piece of chain jewelry 12 is placed over any post and the lid section 24 were closed, the lid section 24 would prevent the hooped ends 14, 16 of the chain jewelry 12 from inadvertently sliding off any post.

Figure 3:
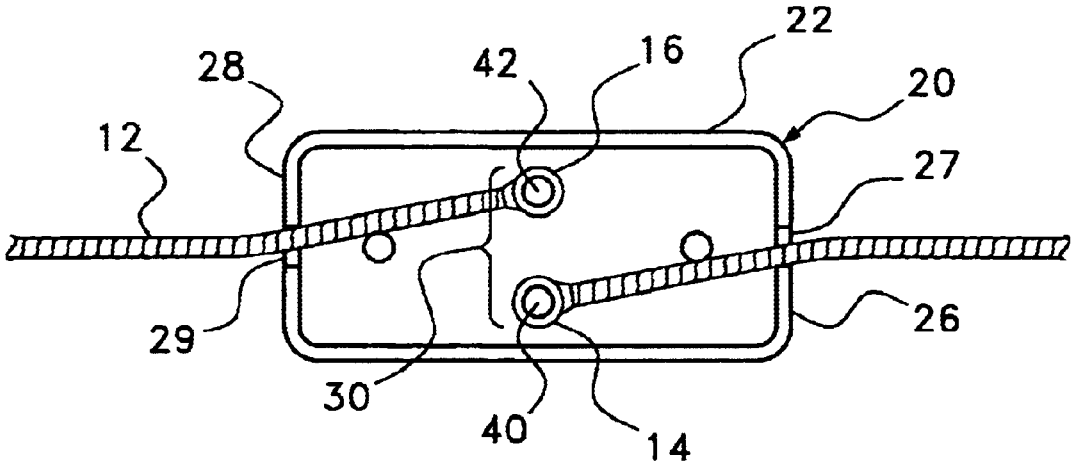
FIG. 3 is a plan view of the embodiment of FIG. 1, shown in a standard clasping configuration.

Referring now to FIG. 3, it can be seen that the present invention clasp device can be used as a traditional clasp by placing the opposing hoops 14, 16 of a piece of chain jewelry 12 around posts 40, 42 in the center post set 30. The opposite ends of the chain jewelry 12 enter the casing 20 through the reliefs 27, 29 in the two ends 26, 28 of the base section 22 of the casing 20. The opposing ends 14, 16 of the chain jewelry 12 are then connected to the posts 40, 42 of the center post set 30 along the most direct path possible. By placing the hooped ends 14, 16 of the chain jewelry 12 onto the posts 40, 42 of the center post set 30, the clasp device 10 retains both ends of the chain jewelry 12 and has only a nominal effect on the length of the chain jewelry 12. Since the hooped ends 14, 16 of the chain jewelry 12 are placed around the posts 40, 42 of the center post set 30, a person need not open and close the clasping mechanism that is designed into the hooped ends 14, 16 of the chain jewelry 12. Rather, the casing 20 of the clasp device is opened, the hooped ends 14, 16 are placed around the posts 40, 42 of the center post 30 and the lid section 22 closed.

The present invention clasp device, however, is capable of much more than just joining together the hooped ends 14, 16 of a piece of chain jewelry 12. The present invention clasp device 10 can join together the hooped ends 14, 16 of a piece of chain jewelry 12 while simultaneously either increasing or decreasing the effective length of the chain jewelry 12.

Figure 4:
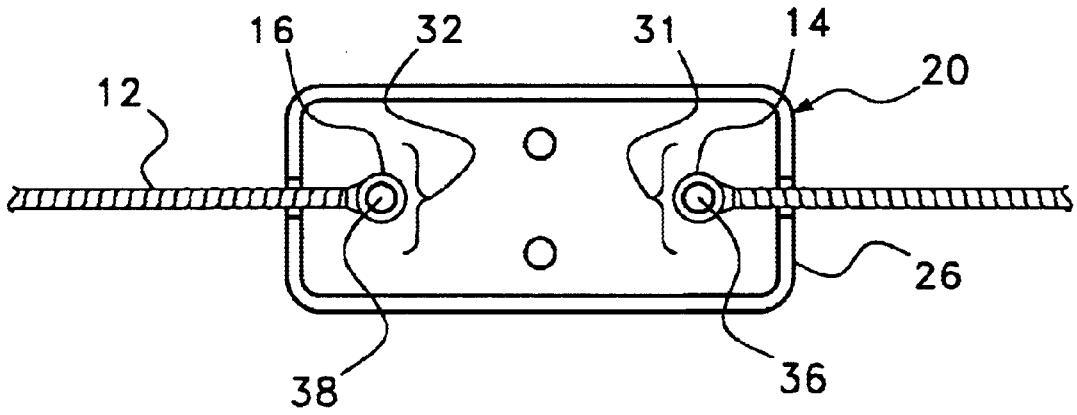
FIG. 4 is a plan view of the embodiment of FIG. 1, shown in an enlarging clasping configuration.

In the embodiment of FIG. 3, the hooped ends 14, 16 of the chain jewelry 12 are joined to the posts 40, 42 of the center post set 30. As such, the effective length of the chain jewelry 12 is little different than if the present invention clasp device were not used. However, by referring now to FIG. 4, it can be seen that the hooped ends 14, 16 of the piece of chain jewelry 12 can be connected to different posts within the casing 20. In FIG. 4, the hooped ends 14, 16 of the chain jewelry 12 are attached to the post 36 of the first end post set 31 and the post 38 of the second end post set 32, respectively. The post 36 of the first end post set 31 and the post 38 of the second end post sets 32 are spaced apart by a predetermined distance. Accordingly, by attaching the hooped ends 14, 16 of the chain jewelry 12 to these posts, the hooped ends 14, 16 of the jewelry chain 12 are separated by that predetermined distance. This results in the jewelry chain 12 appearing to be longer than it actually is. Thus, a nine inch necklace can be caused to hang as low as a ten inch necklace by using the present invention clasp device in the configuration of FIG. 4.

Figure 5:
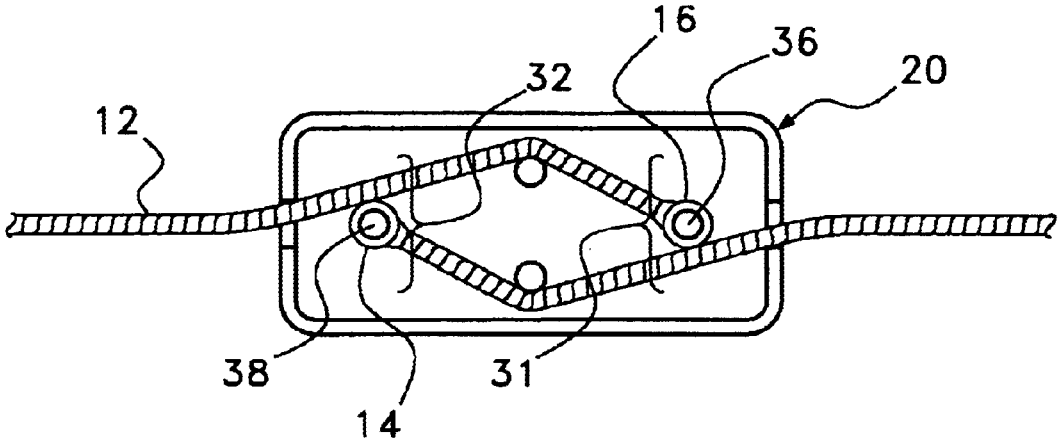
FIG. 5 is a plan view of the embodiment of FIG. 1, shown in a simple shortening configuration.

Referring to FIG. 5, it can be seen that the present invention clasp device can also be used to shorten the effective length of a piece of chain jewelry 12. Each hooped end 14, 16 of the chain jewelry 12 can be advanced into one side of the casing 20 and attached to the post set near the opposite side of the casing 20. In this manner the two hooped ends 14, 16 of the chain jewelry 12 overlap within the casing 20. As a result, the effective length of the chain jewelry 12 can be shortened while maintaining the hooped ends 14, 16 of the chain jewelry 12 and the excess of the chain jewelry 12 confined within the casing 20 of the clasp device.

In FIG. 5, the hooped end 16 of the chain jewelry 12 incoming from the left is placed over the post 36 of the first end post set 31 on the right side of the casing 20. Similarly, the hooped end 14 of the chain incoming from the right is placed over the post 38 of the second end post set 32 on the left side of the casing 20. As a result, the jewelry chain 12 is shortened by at least twice the distance between the first end post set 31 and the second end post set 32.

In the shown embodiment, the clasp device contains a matrix of four posts that are disposed in three post sets. With such a structure, the hooped ends 14, 16 of a jewelry chain 12 can be wound in a few different configurations around the various posts. The number of times a section of a jewelry chain 12 can pass around any one post is limited only by the thickness of the chain, the space available between the posts and the space available between the posts and the surrounding casing.

Figure 6:
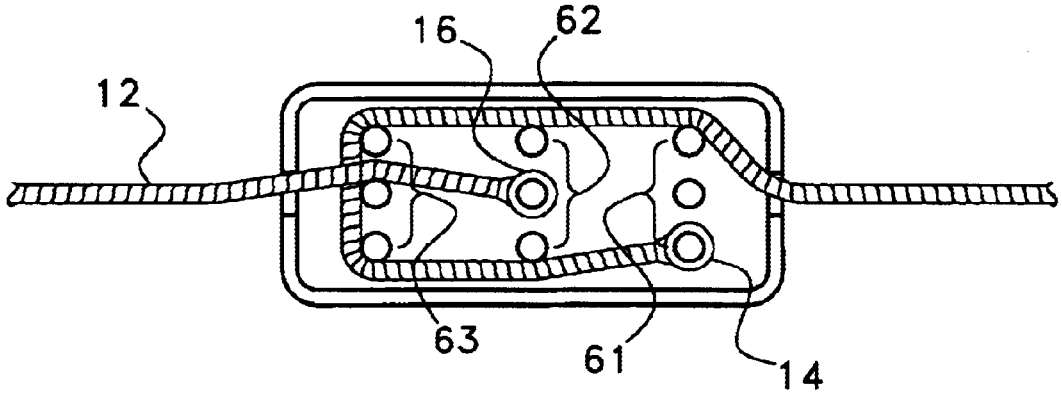
FIG. 6 is a plan view of an alternate embodiment of the present invention, shown in a complex shortening configuration.

Referring to FIG. 6, a more complex embodiment of the present invention clasp device is shown. In this embodiment, the first end post set 61, the center post set 62 and the second end post set 63 all contain three posts. By using more posts, the jewelry chain 12 can be wound around the posts in a larger number of possible ways. Accordingly, more subtle changes can be created in the effective length of the jewelry chain 12. By using complex serpentine windings, each hooped end 14, 16 of the jewelry chain 12 can be effectively shortened by a length much longer than the length of the casing.

Regardless of how much of the jewelry chain 12 is wound in the casing, the hooped ends 14, 16 of the jewelry chain 12 and the unused portions of the jewelry chain 12 are contained within the confines of the casing of the clasp device. As such, the length of the jewelry chain 12 extending from the clasp device can be varied. The number of rows of posts and the number of posts in each row can be varied. As such, it will be understood that the embodiments of the present invention clasp device that are specifically described and illustrated are merely exemplary and the shown embodiment can be modified in many ways. For example, more than one set of posts can be placed on either side of the center post set. Numerous posts or one post can be in each post set. All such alternate embodiments and variations are intended to be included within the scope of the claims as listed below.

What is claimed is:

1. An assembly for receiving two ends of a jewelry chain that are terminated with hooped ends, said assembly comprising:

a casing having a first side and an opposite second side, said casing defining an internal area and further defining a first opening in said first side of said casing and a second opening in said second side of said casing through which the jewelry chain can pass into said internal area;

a center post set disposed within said internal area, wherein said center post set contains a plurality of posts that are equidistant from said first opening and said second opening of said casing;

a first end post set disposed between said center post set and said first end of said casing, wherein said first end post set contains at least one post; and a second end post set disposed between said center post set and said second end of said casing, wherein said second end post set contains at least one post.

2. The assembly according to claim 1, wherein said first end post set and said second end post set are symmetrically disposed on either side of said center post set.

3. The assembly according to claim 1, wherein said casing includes a base section and a lid section that combine to define said internal area, wherein said lid section is selectively openable, thereby selectively providing access to said internal area.

4. The assembly according to claim 3, wherein said first end post set contains a post that is linearly aligned with said first opening and said second opening in said casing.

5. The assembly according to claim 4, wherein said second end post set contains a post that is linearly aligned with said first opening and said second opening.

6. The assembly according to claim 5, wherein said center post set, said first end post set and said second end post are arranged in parallel rows in said casing.

7. The assembly according to claim 5, wherein both said first end post set and said second end post set contain a single post.

8. A method of joining the ends of a jewelry chain, comprising the steps of:

providing a casing having a first end and an opposite second end, said casing defining an internal area between said first end and said second end, wherein said casing has a plurality of posts within the internal area that are arranged in three rows that include a center post set, a first end post set and a second end post set;

advancing one end of the jewelry chain through said first end of said casing;

advancing an opposite end of the jewelry chain through said second end of said casing;

winding said jewelry chain around said plurality of posts within said casing until a predetermined length of said jewelry chain extends between said first end and said second end of said casing outside of said casing.

9. The method according to claim 8, wherein the jewelry chain has hooped ends and said method further includes placing said hooped ends on separate posts of said plurality of posts.

10. A method of selectively shortening or lengthening the hanging length of a necklace chain, comprising the steps of:

providing a necklace chain having a first end and a second end, wherein when said first end is clasped to said second end and worn, said necklace has a predetermined hanging length;

providing a casing having a first side and an opposite second side, said casing defining an internal area between said first side and said second side, wherein said casing has a plurality of posts within the internal area that include a center post set, a first end post set between said center post set and said first side, and a second end post set between said center post and said second side;

connecting said first end of said jewelry chain and said second end of said jewelry chain to separate posts of said plurality of posts in said casing, thereby selectively altering said hanging length of said jewelry chain.

11. The method according to claim 10, wherein said step of connecting said first end of said jewelry chain and said second end of said jewelry chain to separate posts increases said hanging length of said jewelry chain.

12. The method according to claim 10, wherein said step of connecting said first end of said jewelry chain and said second end of said jewelry chain to separate posts decreases said hanging length of said jewelry chain.

13. The method according to claim 10, further including the step of winding said jewelry chain around said plurality of posts within said casing until a desired hanging length of said jewelry chain is achieved.

* * * * *